United States Patent [19]

Vosburgh

[11] Patent Number: 4,763,847

[45] Date of Patent: Aug. 16, 1988

[54] IMPLEMENT FOR INNER INSPECTION AND DESTRUCTION OF PLASTIC SECURITY CONTAINERS

[76] Inventor: Gary A. Vosburgh, RD#1 Box 151 Birchwood Dr., Duanesburg, N.Y. 12056

[21] Appl. No.: 912,972

[22] Filed: Sep. 29, 1986

[51] Int. Cl.[4] ..... B02C 1/04

[52] U.S. Cl. ..... 241/169; 241/168; 241/199.11; 241/264

[58] Field of Search ..... 241/168, 169, 169.1, 241/169.2, 198 R, 199.11, 262–269

[56] References Cited

U.S. PATENT DOCUMENTS

| | | | |
|---|---|---|---|
| 731,557 | 6/1903 | Fanner | 241/168 |
| 3,915,393 | 10/1975 | Elkins | 241/168 |
| 4,314,676 | 2/1982 | Maclean | 241/169 |
| 4,473,192 | 9/1984 | Urban et al. | 241/168 |

*Primary Examiner*—Howard N. Goldberg
*Assistant Examiner*—Joseph M. Gorski

[57] ABSTRACT

This invention relates to an apparatus for striking an inspection window, and destroying any future uses of plastic security containers, by utilizing a single lever arm using one pivot point and a crushing chamber. Plastic security containers placed into a crushing chamber are destroyed when force is applied to the single lever arm. Structure is provided to prevent expulsion of debris from the plastic security container.

1 Claim, 1 Drawing Sheet

A-A

IMPLEMENT FOR INNER INSPECTION AND DESTRUCTION OF PLASTIC SECURITY CONTAINERS

BACKGROUND OF THE INVENTION

The National Security Agency uses plastic security containers to house communication security material (COMSEC) in their COMSEC centers. These plastic security containers are lightweight and very durable and have been proven to be a very reliable means to store this type of information. However, the problem area is in the destruction and inspection of these containers after useful material had been depleted. Under a directive from the Government, these plastic security containers were to be set on the floor and struck with a sledge hammer. It would be advantageous if a portable inspection and destruction crushing device could be designed that was efficient and safe enough for use.

Other devices for crushing are known, but are used exclusively on aluminum products such as cans. These devices are not suitable for the use on plastics, nor do they provide the additional safety features required to contain any hazardous projection of plastic.

SUMMARY OF THE PRESENT INVENTION

The main purpose of the present invention is to provide a device to destroy plastic security containers in such a manner that they cannot be reused, and that a quick investigation can be made on the inside, of these containers to insure no COMSEC material is left within.

When security containers are void of useful material, these plastic security containers can be inserted into the device's crushing chamber using the device's centering rails to keep the plastic security container stable and centered during the crushing cycle. By the use of the lever arm, having a hand grip at one end with the other end pivoted to the crushing chamber, the crushing hammer can be lowered by applying a modest force to the lever arm. The plastic security container will be destroyed quickly and efficiently. The present device's lever arm can then be raised to clear the crushing chamber and angled toward the operator so the plastic security container will slide free of the device's crushing chamber for a final inspection.

An equally important purpose is to provide a safe method in which this invention can be used over its predecessor, the sledge hammer. The disadvantages of the prior method was that the sledge hammer was very heavy, a considerable amount of skill and strength was required to hit the security containers on the floor to destroy them correctly, and the containment of the debris.

The present invention has the means for keeping splintered plastic pieces of the plastic security container contained within the crushing chamber by the use of a rubber shatter guard, which makes this device very safe and useful.

An additional purpose is to provide the mechanical advantage where by these plastic security containers can be destroyed with a minimal amount of strength. Still another advantage of this device is that it is portable, simple, and easy to use.

DETAILED DESCRIPTION OF THE PREFERRED EMBODIMENT

Figure 1:
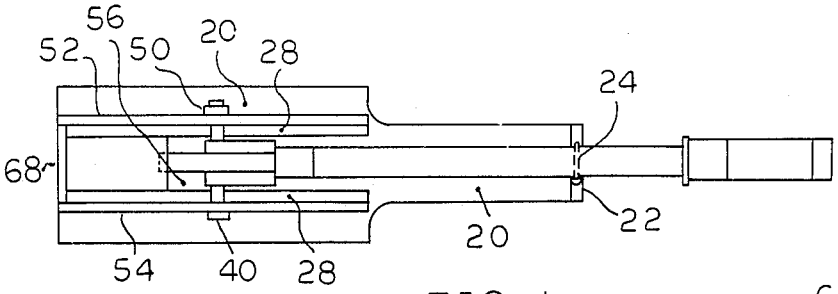
FIG. 1 is a top elevation view of the full embodiment, crushing chamber and centering rails.
Figure 3:
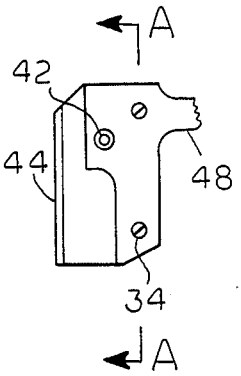
FIG. 3 is a side view of the crushing hammer.
Figure 4:
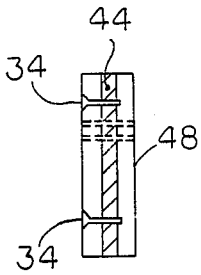
FIG. 4 is a front view of the crushing hammer and steel cutter.
Figure 6:
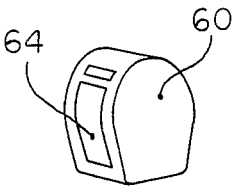
FIG. 6 is a perspective of a plastic security container to be crushed.

The plastic security container destroying device according to the invention illustrates in FIG. 1 the structure of the crushing chamber 56 where crushing takes place. The crushing housing includes a base plate 20, a back plate 68, and side plates 52 and 54 which are welded together. A steel bolt 40 passes through side plates 52 and 54 and through the bushing 42 in the crushing hammer pivot point in FIG. 3 for the ease of rotating the lever arm up and down and is secured by the use of a lock nut 50. The centering rails 28 are tack welded to base plate 20 and are used for inserting plastic security containers 60 in FIG. 6 into the crushing chamber 56 and to hold them stable during the crushing cycle. Illustrated in FIG. 5.

Figure 7:
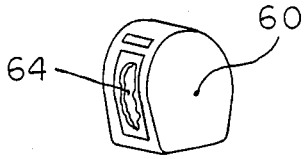
FIG. 7 is a perspective of a plastic security container having been crushed.
Figure 2:
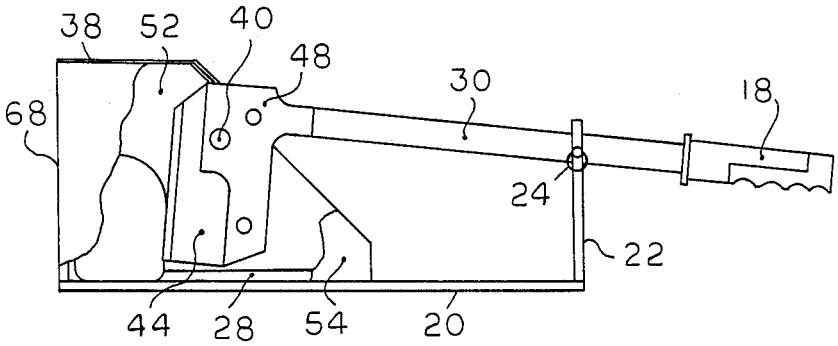
FIG. 2 is a cutout side view of the present invention showing the crusher in the fully closed position with the crushing hammer handle in the locked and carrying position, and the rubber shatter guard covering the crushing chamber.
Figure 5:
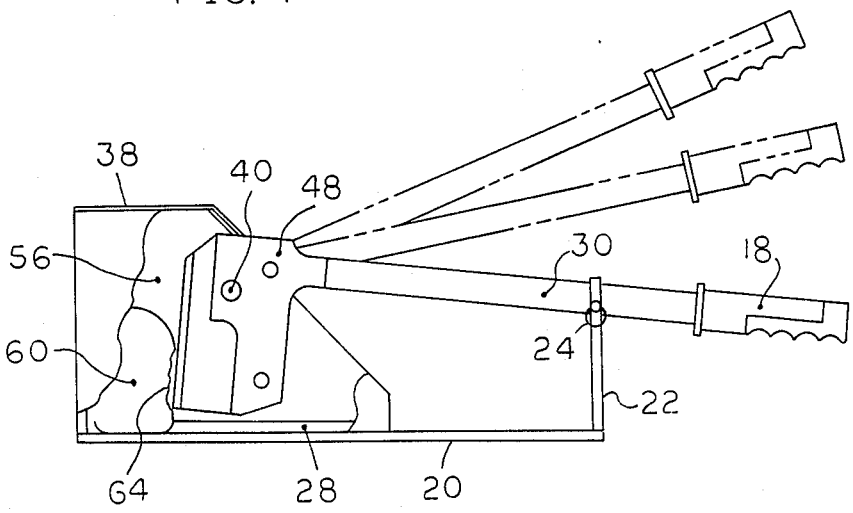
FIG. 5 is a full embodiment side view with cutout, of the present invention showing a complete crushing cycle.

In the use of the device, FIG. 2 shows the lever arm 30 has a hand grip 18 on its free end. When the device is in its stored or quiescent state, it is held with a quick disconnect pin 24 which holds the lever arm 30 into the stop latch 22 which also enables you to carry this device. The rubber shatter guard 38 which is fastened to the top of the back plate 68 in FIG. 2 by means of rubber cement and covers the top of the crushing chamber. FIG. 5 illustrates the nature in which crushing device is used. When the device is in the resting position shown in FIG. 2, the quick disconnect pin 24 is pulled out, and the level arm 30 is raised by the hand grip 18 to a loading position that clears the crushing hammer 48 from the centering rails 28 and the crushing chamber 56 which inturn raises the rubber shatter guard 38. The operator then slides the plastic security container 60 in FIG. 6 with the face 64 of FIG. 6 facing toward the stop latch 22 using the centering rails 28 for guidance into the crushing chamber 56. The lever arm is then lowered until the crushing hammer's steel cutter 44 in FIG. 3 touches the face of the security container 64 in FIG. 6. At this time the rubber shatter guard 38 completely covers the top of the crushing chamber 56 preventing plastic from popping out of the crushing chamber 56. Force is then applied to the hand grip 18 and transferred to the crushing hammer 48 and strikes out an inspection window in the plastic security container as shown in 64 in FIG. 7. Force is applied until it comes to rest on the stop latch 22. The crushing cycle will be completed at this point. The final inspection can be carried out by raising the hand grip 18. To clear the centering rails 28 and crushing chamber 56 and tilting the device toward the operator, the plastic security container will slide free of the device's crushing chamber 56. Lower the lever arm 30 to stop latch 22 position and replace quick disconnect pin 24.

What is claimed is:

1. A hand operated apparatus for opening inspection windows of security containers and destroying the security containers, comprising:

a base plate;

a first side plate connected to said base plate and extending upwardly therefrom;

a second side plate connected to said base plate and extending upwardly therefrom parallel to said first side plate;

a back support plate extending upwardly from said base plate and being connected to said base plate, said first side plate and said second side plate, so that a chamber is formed;

a front lever arm support plate connected to said base plate and extending upwardly therefrom;

a first centering rail located within said chamber;

a second centering rail located within said chamber and spaced from said first centering rail;

a lever arm having a hand grip at a first end thereof;

a hammer head connected to said lever arm at a second end thereof;

a pivot pin passing through and connecting said first side plate, said second side plate, and said hammer head;

a lever arm securing latch on said front lever arm support plate;

a cutter on a front end of said hammer head; and a shatter guard covering said chamber.

* * * * *